US008928545B2

(12) United States Patent
Gommé et al.

(10) Patent No.: US 8,928,545 B2
(45) Date of Patent: Jan. 6, 2015

(54) MULTI-BAND ANTENNA

(71) Applicant: NX B.V., Eindhoven (NL)

(72) Inventors: Liesbeth Gommé, Anderlecht (BE); Anthony Kerselaers, Herselt (BE)

(73) Assignee: NXP, B.V., Eindhoven (NL)

( * ) Notice: Subject to any disclaimer, the term of this patent is extended or adjusted under 35 U.S.C. 154(b) by 284 days.

(21) Appl. No.: 13/625,055

(22) Filed: Sep. 24, 2012

(65) Prior Publication Data

US 2013/0141297 A1 Jun. 6, 2013

(30) Foreign Application Priority Data

Dec. 5, 2011 (EP) ..... 11191876
May 16, 2012 (EP) ..... 12168168

(51) Int. Cl.
*H01Q 13/10* (2006.01)

(52) U.S. Cl.
USPC ..... 343/770

(58) Field of Classification Search
CPC ..... H01Q 13/10; H01Q 21/064; H01Q 21/24; H01Q 13/18; H01Q 13/085
USPC ..... 343/770, 771, 700 MS, 702, 767, 846
See application file for complete search history.

(56) References Cited

U.S. PATENT DOCUMENTS 4,509,053 A 4/1985 Robin et al.
5,394,163 A * 2/1995 Bullen et al. ..... 343/771
7,057,563 B2 * 6/2006 Cox et al. ..... 343/700 MS
7,696,931 B2 * 4/2010 Kim et al. ..... 343/702
7,755,546 B2 * 7/2010 Ishimiya ..... 343/702
7,831,230 B2 * 11/2010 Nail et al. ..... 455/168.1
8,203,489 B2 * 6/2012 Li et al. ..... 343/700 MS
2004/0021605 A1 2/2004 Kouam et al.
2004/0135729 A1 7/2004 Talvitie et al.
2010/0182202 A1 7/2010 Shih
2012/0223864 A1 9/2012 Kerselaers

FOREIGN PATENT DOCUMENTS

CN 1551410 A 12/2004
CN 101867086 A 10/2010
DE 10 2007 055327 A1 6/2009
DE 10 2008 043242 A1 4/2010
DE 10 2009 038038 A1 2/2011
EP 1 294 049 A1 9/2003

(Continued)

OTHER PUBLICATIONS

Extended European Search Report for Application No. 12168168.8 (Aug. 2, 2013).

(Continued)

*Primary Examiner* — Huedung Mancuso

(57) ABSTRACT

The invention provides a multi-band antenna comprising a planar substrate which in use is intended for vertical mounting, and has a bottom edge and a top edge. A conductor pattern is printed on one side of the substrate with three slots. A first slot is a U or J shape facing downwardly and a second is a U or J shape facing upwardly. A third slot extends in the vertical direction and is open at the top. A first antenna feed is coupled to a horizontal track of the second slot and a second antenna feed is coupled to the third slot. The three slots together provide multi-band performance in three bands.

10 Claims, 9 Drawing Sheets

(56) References Cited

FOREIGN PATENT DOCUMENTS

| | | | |
|---|---|---|---|
| EP | 1 471 599 | A1 | 10/2004 |
| EP | 2 208 880 | A2 | 7/2010 |
| EP | 2 495 808 | A1 | 9/2012 |
| GB | 2 389 964 | A | 12/2003 |
| TW | 200 840 146 | A | 10/2008 |
| WO | 01/26182 | A1 | 4/2001 |

OTHER PUBLICATIONS

Office Action from Counterpart application 201210504616.3 (Aug. 4, 2014).

* cited by examiner

| marker | f [GHz] | R + j X [50Ω normalized] |
|---|---|---|
| m1 | 5.9 | 0.9974 + j 0.0173 |

MULTI-BAND ANTENNA

CROSS-REFERENCE TO RELATED APPLICATIONS

This application claims the priority under 35 U.S.C. §119 of European patent application nos. 11191876.9, filed on Dec. 5, 2011,and 12168168.8 filed on May 16, 2012, the contents of each of which are incorporated by reference herein.

The invention relates to a multiband antenna suitable for auto applications.

The invention relates in particular to the shark fin antenna. FIG. 1 shows an example of a standard shark fin antenna unit that is positioned at the backside of the rooftop of a vehicle. The antennas embedded in the shark fin are restricted in dimensions and should be designed to fit in the housing. The antenna unit also has stringent requirements for weather protection, shock resistance and temperature rise. Standard dimensions for the antenna unit are: Maximum height of 50 to 55 mm (external housing height of 60 mm), Length of 120 mm (external housing length of 140 mm), Width of 40 mm (external housing width of 50 mm).

The maximum achievable height of around 50 mm has some implications on attainable frequency since there is a dependency of frequency and antenna size. A single resonant antenna element has dimensions which are proportional to the wavelength of operation and inversely proportional to the frequency of operation. Hence, low operating frequencies require large antenna structures. A resonant quarter wave monopole antenna ($L=\lambda/4$) is a classical antenna that is used above a rooftop of a vehicle or above a ground plane.

The GSM900 standard uses the lowest frequency band of the communication standards today in Europe. A quarter wave monopole antenna would require a length of 77 mm for this frequency band which is too long to be implemented in a shark fin unit. Reduction in size is thus required. However, size reduction will reduce the fractional bandwidth and the radiation resistance. This leads to increased return loss and thus not optimal matching of the antenna to the radio.

According to the invention, there is provided a multi-band antenna as claimed in claim 1.

The invention provides a multi-band antenna comprising:

a planar substrate which in use is intended for vertical mounting, and has a bottom edge and a top edge;

a conductor pattern printed on one side of the substrate and which in use is intended to be grounded at one end to a horizontal conducting plane, wherein the conductor pattern comprises a continuous conductor area having slots defined into the area, the slots at one end opening to an edge of the conductor area, the slots comprising:

a first slot having a horizontal track located near the top edge and at least one downward vertical track extending down from one end;

a second slot having a horizontal track located near the bottom edge and at least one upward vertical track extending down from one end, wherein the downward and upward vertical tracks end with a gap between them; and a third slot extending in the vertical direction and open at the top, the third slot being formed to the side of the first and second slots, adjacent the upward and downward vertical tracks;

a first antenna feed to the horizontal track of the second slot; and a second antenna feed to the third slot.

This design has three antenna slots, which can be tuned to different frequencies, and two antenna feeds. The third antenna slot enables tuning to a high frequency, so that a three band antenna is formed.

The first antenna feed can be for a lowest frequency band and an intermediate frequency band, and the second antenna feed can be for a highest frequency band. By way of example, the lowest frequency band can be within the range 825-960 MHz, the intermediate frequency band can be within the range 1.7-4.2 GHz and the highest frequency band can be within the range 4.95-6.0 GHz.

The third slot is tuned to a frequency in the highest range, and can have a width in the range 2.0 mm to 3.0 mm and a depth in the range 5.0 mm to 12.0 mm. The third slot preferably defines an antenna which is located between two anti-resonances, wherein the second anti-resonance frequency is lower than 3 times the first anti-resonance frequency.

The antenna can comprise a vehicle antenna. In this case, it can have an outer housing for mounting on a vehicle roof, the outer housing comprising a vertical web in which the planar substrate is positioned, wherein the outer housing has a height of less than 80 mm, a width of less than 70 mm and a length of less than 200 mm.

The invention also provides a vehicle communications system, comprising an antenna of the invention and a GPS module within the outer housing and/or a further high frequency antenna within the outer housing.

Examples of the invention will now be described in detail with reference to the accompanying drawings, in which.

The invention provides a multi-band antenna comprising a planar substrate which in use is intended for vertical mounting, and has a bottom edge and a top edge. A conductor pattern is printed on one side of the substrate with three slots. A first slot is a U or J shape facing downwardly and a second slot is a U or J shape facing upwardly. A third slot extends in the vertical direction and is open at the top. A first antenna feed is coupled to a horizontal track of the second slot and a second antenna feed is coupled to the third slot. The three slots together provide multi-band performance in three bands.

Figure 1:
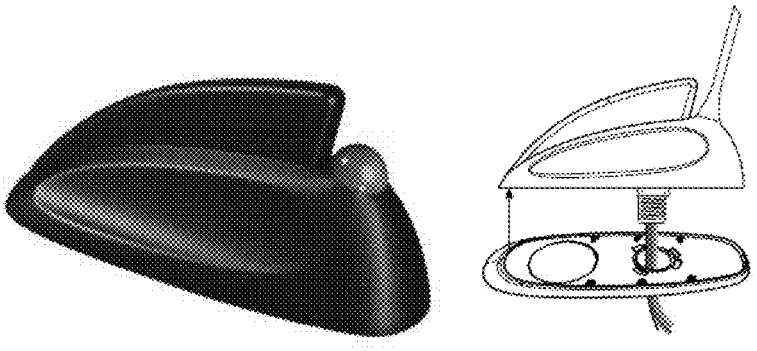
FIG. 1 shows a known housing for an antenna to be mounted on a vehicle roof.
Figure 2:
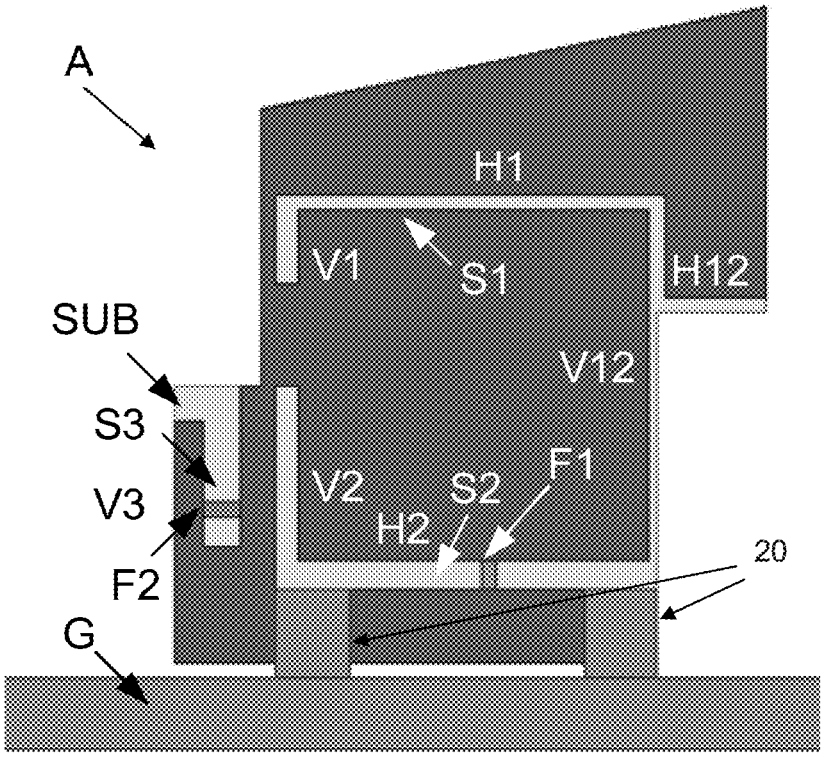
FIG. 2 shows an example of multiband antenna of the invention.

FIG. 2 shows the proposed multiband antenna A. The antenna consists of a vertical planar conducting surface connected to a ground plane G. The conducting surface is attached to a planar substrate SUB which is thus oriented vertically. The substrate can be a printed circuit board material like FR4 or any dielectric material that has sufficient performance for the frequency bands of operation. The choice of substrate can be kept low cost and the fabrication can be kept very low cost since existing technologies for printed circuit boards can be used.

The conducting surface can be copper or another material that has sufficient performance for the frequency bands of operation. The conducting surface can be very thin, for example 35 μm. The conducting surface can be covered by a protecting layer to prevent oxidation and to reduce degradation due to temperature and as such to fulfil the stringent automotive requirements.

The antenna A is a one-sided structure and has only on one side of the substrate a conducting surface making it a low cost concept in terms of manufacturing. The conducting surface is connected to the ground plane G at the bottom by two holders 20 which also fix the substrate in its vertical orientation, perpendicular to the ground plane G. In this way the conductive surface can be considered as an extension of the ground plane. The inclined shape at the top side of the antenna is adapted to fit the shape of the shark fin. The conducting surface contains a number of open slots, S1, S2 and S3. By "open" is meant that one end of the slot extends fully to the edge of the conductor area, whereas the opposite end is closed. Having open slots allows the antenna to operate efficiently as a resonant quarter wavelength monopole antenna.

The open slots Si and S2 have horizontal and vertical parts V1, V2, V12, H1, H2. The open slot S3 only has a vertical part V3. Open slot S2 is close to the ground plane while open slot S1 is located closer to the top side. Open slot S2 creates a means of feeding the antenna and it contains a vertically oriented feeding port F1 (i.e. perpendicular to and across the slot width at that point) located approximately in the centre of the horizontal part H2 of open slot S2. However, the lowest operating frequency that can be used is defined by the quarter wave length of the antenna. A much lower operating frequency can be obtained by implementing open slot S1.

Slot S3 can be seen as an independent structure with its own feeding port F2 oriented horizontally (i.e. perpendicular to and across the slot width at that point) that operates at the highest desired frequency.

Thus, the conducting surface comprises a vertical sheet conductor in which a first U- or J-shaped slot S1 is near the top of the conductor facing downwardly, and the a second U- or J-shaped slot S2 is near the bottom of the conductor facing upwardly. One limb of each slot meet each other so that a shared slot part is defined (part V12) whereas the other limbs of each slot are spaced apart (V1 and V2). In the example shown, with the horizontal parts H1 and H2 of the same length, the two slots S1 and S2 together define a rectangular slot which is only interrupted along one of the vertical sides (the gap between V1 and V2). A first feeding port F1 connects across the lower horizontal path H2 of the second slot S2.

The third slot S3 is in a different area of the conducting surface, outside the area enclosed by the rectangular slot defined by the combined slots S1 and S2. This slot S3 can for example extend in the vertical direction having a vertical slot V3, thereby defining a U-shaped conductor path around the third slot S3. A second feeding port F2 connects across the third slot S3.

Each feeding port is part way along its respective slot. Each feeding port is at a location on the substrate that may be mounted with a socket to which an external electrical connection can be made. In use, coaxial cables (not shown) are connected to the feeding ports in order to send signals to, and receive signals from, the respective antenna. Each feeding port has two terminals. A signal terminal of the feeding port is situated on the conductive region on one side of the slot. During use, an inner conductor of the coaxial cable can be coupled directly to this conducting region via the signal terminal of the feeding port. A ground terminal of each feeding port is located on the conductive region on the opposite side of the slot. In use, a conducting shield of the coaxial cable can be coupled to this opposite side conductive region via the ground terminal of the feeding port 230. These conductive regions are coupled to the ground plane G.

The feeding ports are thus configured such that the signal terminal and the ground terminal are proximal to one another either side of the respective slot facing one another.

In this example, the feeding port F1 is located about halfway along the horizontal section H2 of the second slot S2. The precise location of the feeding port F1 along the section H2 can have an effect on the frequency response of the antenna, and can be located during design in order to fine tune the performance of the antenna.

The lowest operating frequency that can be received at/transmitted from the antenna is defined by the height of the antenna. Inclusion of the first slot S1 enables a much lower operating frequency to be achievable than would otherwise be possible. The two slots S1, S2 mean that two main frequency bands are created when considering feeding port F1, a lower frequency band and an intermediate frequency band. When considering feeding port F2, the higher frequency band is created.

The lower frequency band is for example suitable for one communication standard, like GSM900. The intermediate frequency band is for example suitable for many existing communication standards such as GSM1800, UMTS-FDD and PCS, for Wireless LAN 802.11b/g and for future standards.

The higher frequency band targets Car-to-Car (C2C) and Car-to-Infrastructure (C2I) communication using 802.11p at 5.9 GHz and may even support 802.11 a starting from 5 GHz.

The length of the open slots S1 and S2 can be adapted to align the lower band edges of both the lowest and the intermediate frequency band. For example reducing the length of the vertical part V1 of the open slot Si increases the low band edge of the lower and higher frequency band but not in the same amount. Reducing the length of the vertical part V3 of the open slot S1 increases the low band edge of the higher frequency band mainly.

Reducing the size of the vertical part V2 of open slot S2 can improve the wideband response of the higher frequency band. Other dimensions have also influence on the band edges of the frequency bands.

The width of the horizontal part H1 of open slot S1 influences the band edges of both lower and intermediate frequency bands. The width of the horizontal part H2 of open slot S2 influences the wideband response of the intermediate frequency band. Elongating the inclined surface to the right and hence increasing the length of the horizontal part H12 brings the band edges of the lower frequency band to a lower frequency.

As it can be understood from the above explanation it is possible to align frequency bands according to required specifications.

From the above discussion it is clear that the open slots are essentially defining band edges. This is a very interesting property since this means that the antenna is much more resistant to detuning due to nearby objects or other antennas compared with other type of antennas. This is an important behaviour since many antennas are closely packed together in a small volume.

As for the structure in the front defined by the third slot S3, the length of the slot, the width of the slot V3, the width of the strip to the left of the slot V3 and the distance from the horizontal feeding port to the bottom of the slot V3, define the antenna characteristics. The distance from feeding port to bottom of the slot defines mainly the operating frequency, i.e. raising the feeding port F2 brings the band edges to a higher frequency. Making the slot V3 wider also brings the band edges to a higher frequency. The bandwidth is defined by the width of the strip, i.e. the response is less wideband if the width of the strip is increased to the right of the slot. Reducing the slot width of V3 also makes the response less wideband. Reducing the distance from feeding port to bottom of the slot, makes the response also less wideband.

The double slot design S1 and S2 been proposed by the applicant in its co-pending application EP11250243.0.

This invention relates in particular to the design of the third slot S3 which is dedicated to 802.11a and 802.11p with a separate feeding port F2. To demonstrate the advantages of this structure, simulations based on exciting this feeding port are discussed further.

Figure 3:
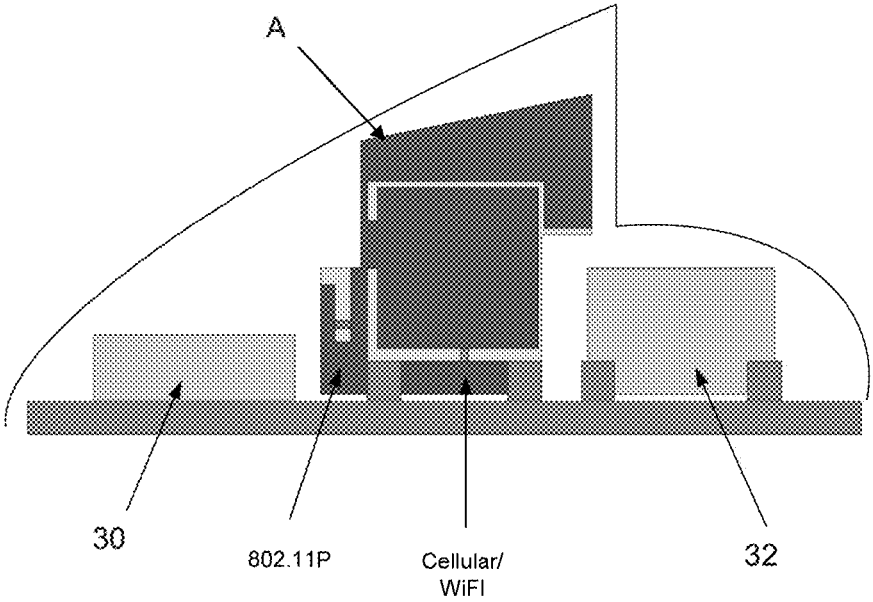
FIG. 3 show the antenna of FIG. 2 mounted in a compact shark fin that contains other components.

FIG. 3 show the antenna A mounted in a compact shark fin that contains other components, such as for example a commercial off the shelf (COTS) GPS module 30 in front of the multiband structure or/and a second (802.11P) antenna structure 32 for diversity purposes behind the multiband antenna.

The very compact and highly integrated application of the multiband antenna in such a shark fin obviously poses some important design challenges. In the simulation results shown below, account has therefore been taken of a practical application of the multiband antenna (with a GPS unit in front of the multiband antenna and an additional antenna structure behind the multiband antenna). These structures obviously influence the antenna parameters and simulating the total application is therefore essential.

The properties and features of the antenna of FIG. 2 are:

- It supports multiple communications standards as 2G/3G (GSM850, GSM900, GSM1800, UMTS-FDD, PCS) and Wi-Fi (802.11b/g) and 802.11a (4.9-5.8 GHz) and 802.11p (5.9 GHz) communication (car2car and car2infrastructure).
- It has a dual feed connection (to radios), this is a big advantage since no duplexers are required for 802.11p (5.9 GHz) communication.
- 802.11p operation requires no additional antenna in front of the GPS antenna in a classical shark fin module.
- The structure contains 3 open slots to define 3 different frequency bands.
- The new 3rd slot, S3, has only a vertical section.
- The new 3rd slot, S3, has a horizontal feeding port F2.
- The new 3rd slot, S3, delivers a directional (forward) radiation pattern
- The new upper frequency band that is created by means of the 3rd slot provides a large frequency band because it is operated in series resonance, located between two anti-resonances.

Figure 5:
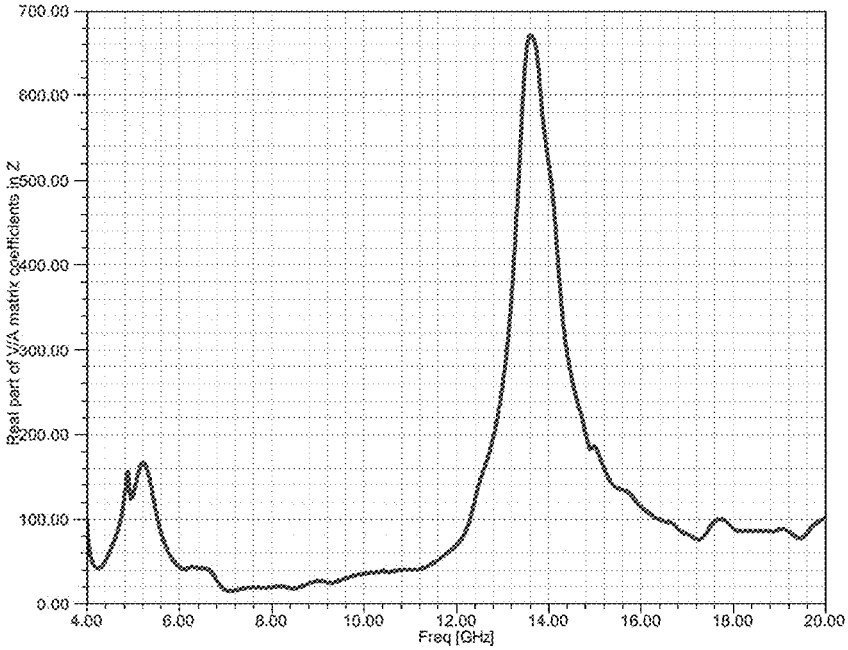
FIG. 5 shows the simulated input resistance at feeding port F2.

A quarter wave slot antenna works usually at anti-resonance. This is because such a slot structure is equivalent to a parallel circuit of inductance and capacitance. This operation mode is usually not wideband due to the relatively large change of the real part of the input impedance. In the antenna design of the invention, this first anti-resonance frequency can be pushed below the frequency band of interest, in order to make the antenna wideband. This is possible due to a slower change of the real part of the input resistance between the first and the second anti-resonance (as can be seen in FIG. 5).

With this method the distance from feeding port F2 to the bottom of the slot S3 defines mainly the operating frequency, i.e. raising the feeding port F2 brings the band edges to a higher frequency. This is a fundamentally different concept compared to other slot antennas where the feed position only determines the input impedance. The second anti-resonance is usually a bit lower in frequency due to capacitive coupling. In order to use the series resonance frequency between the two anti-resonances with sufficient radiation resistance, the second anti-resonance frequency should be lower than 3 times the first anti-resonance. According to an embodiment, the second anti-resonance can be lowered by means of providing sufficient capacitive coupling between the vertical copper structures surrounding the slot S3.

Figure 4:
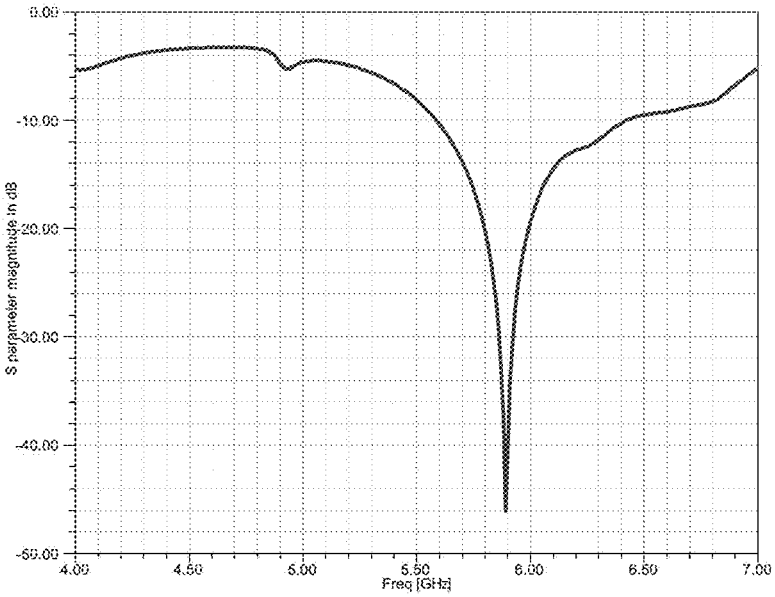
FIG. 4 shows the simulated return loss of the antenna at feeding port F2.

Slot S3 can be seen as an independent structure with its own feeding port F2 while this is part of one overall antenna that operates also at other frequency bands. This means that there is minimal influence (sufficient isolation) between the operation of the new frequency band and the others. The minimal influence between the new frequency band and the other bands is particularly improved because the slot S3 is added in a conductive portion that is at the opposite side of the open ends of slots S1 and S2. FIG. 4 shows the simulated return loss [dB] of the proposed antenna structure at feeding port F2, mounted as shown in FIG. 3. Simulations are carried out with industry leading 3-dimensional electromagnetic simulators like HFSS from Ansoft Corporation or CST Darmstadt Germany.

The higher frequency band can be seen in FIG. 4, which can be very wide, i.e. 800 MHz and the simulated antenna radiation efficiency at 5.9 GHz is very high, e.g. 95%.

Figure 6:
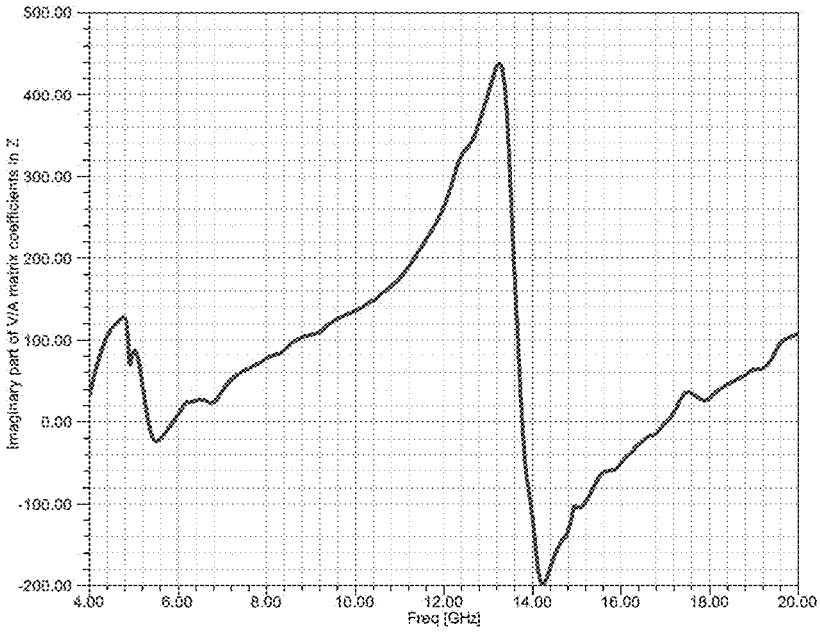
FIG. 6 shows the simulated input reactance at feeding port F2.

FIGS. 5 and 6 depict the simulated input resistance [Ω] and input reactance [Ω] respectively of feeding port F2 of the proposed antenna structure mounted as shown in FIG. 3. In these figures the first anti-resonance is found at approximately 5.3 GHz and the series resonance at approximately 5.9 GHz which is the center of the operational frequency band.

This mechanism supports the operation across a wide frequency range like a significant part of the 802.11a band and the 802.11p band with one feeding port. In FIG. 5 it can be observed that this technique results in relatively constant resistive input impedance, i.e. 50Ω from 5.9 GHz up to 6.4 GHz.

Figure 7:
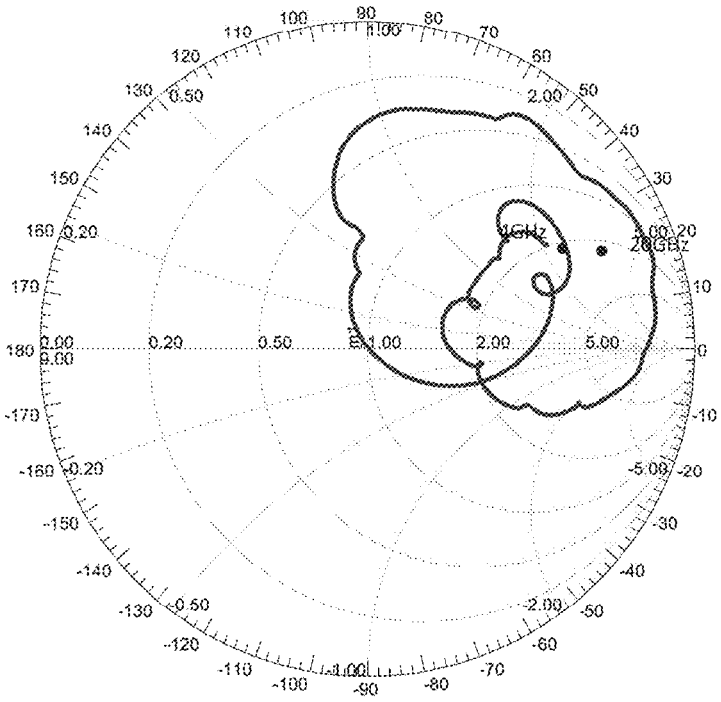
FIG. 7 shows the simulated input impedance of the antenna structure at feeding port F2.

FIG. 7 shows the simulated input impedance [50Ω normalized] of the proposed antenna structure at feeding port F2, mounted as shown in FIG. 3. It can be observed that there are two anti-resonances present in the Smith chart in FIG. 7. A first anti-resonance is found at approximately 5.3 GHz while a second anti-resonance is found at approximately 14 GHz. There is also a series resonance between the two anti-resonances at approximately 5.9 GHz which defines the center of the operational frequency band. Two anti-resonances are inherently in the design, positioned such that both a significant part of the 802.11a band and the 802.11p band can be covered with the same wideband structure. Any antenna having a first anti-resonance antenna has a second anti-resonance antenna at 3 times the first anti-resonance antenna. The second anti-resonance is usually a bit lower in frequency due to capacitive coupling. In order to use the series resonance frequency between the two anti-resonances with sufficient radiation resistance, the second anti-resonance frequency should be lower than 3 times the first anti-resonance.

An embodiment of this invention incorporates the idea of lowering the second anti-resonance by means of providing sufficient capacitive coupling between the vertical copper structures surrounding the slot S3. This can be done with a certain thickness of the side strip and the width of the slot S3.

For example, the slot S3 can be separated from the vertical part V2 of the slot S2 by a track having a width of the same order of magnitude as the width of the slot S3. For example the track between S3 and V2 can be between 0.5 and 10 times the width of slot S3. Slots S3 and S2 may have the same width or they may be different. For example slot S2 may be narrower.

Figure 8:
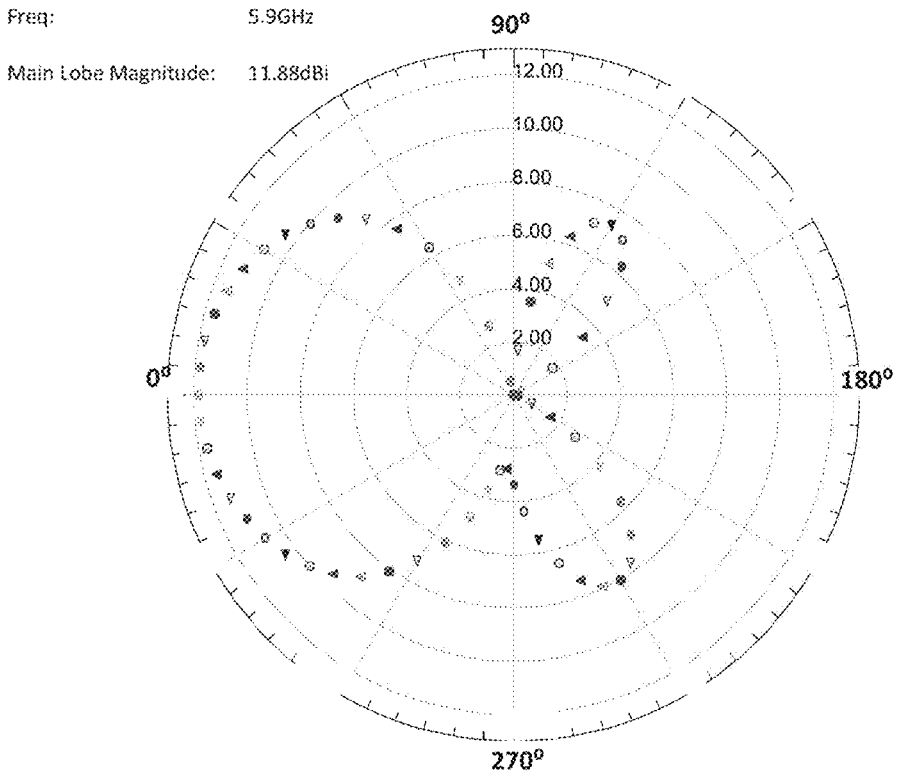
FIG. 8 shows the simulated directivity in the horizontal plane at 5.9 GHz when exciting feeding port F2.

FIG. 8 shows the simulated directivity [dBi] in the horizontal plane at 5.9 GHz measured when exciting feeding port F2 of the proposed antenna structure mounted as shown in FIG. 3. The main lobe magnitude is high, i.e. 11.88 dBi and is found in the forward direction (0°) with respect to the shark fin unit.

Figure 9:
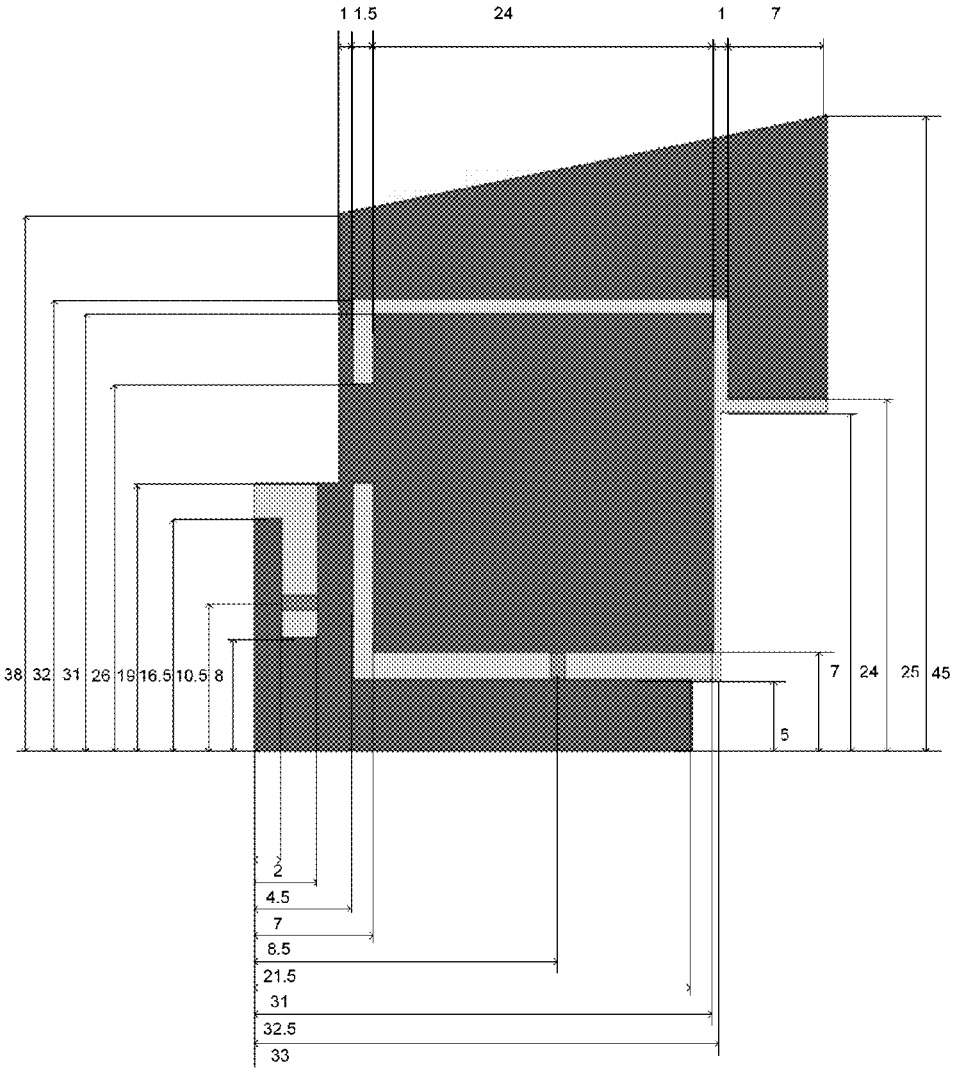
FIG. 9 shows one possible example of the dimensions of the antenna.

FIG. 9 shows one possible example of the dimensions [mm] of the proposed antenna. In this example the substrate material used is low cost FR4 printed circuit board material of a thickness of 1.6 mm, a dielectric constant of 4.4 and a dielectric loss tangent of 0.02. It can be observed from FIG. 9 that the total height of the antenna is below 50 mm, i.e. 45 mm. The inclining top side is shaped to fit a protective cap.

This example has a slot width for slot S3 of 2.5 mm and a slot depth of 8.5 mm, with the centre of the feed F2 2.5 mm from the base of the slot. More generally, the third slot has a width in the range 2.0 mm to 3.0 mm and a depth in the range 5.0 mm to 12.0 mm.

In the example shown, the track between slots S3 and S2 is the same width as the slot S3, to provide the capacitive coupling explained above.

Figure 10:
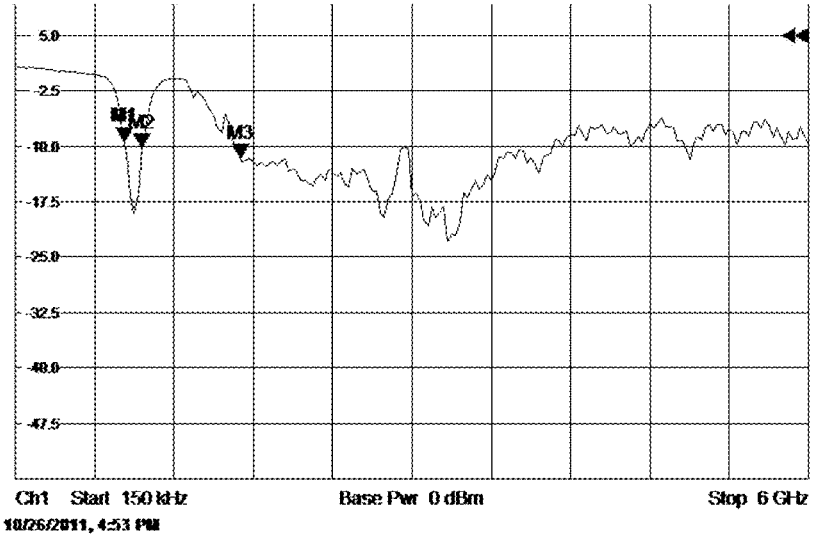
FIG. 10 shows the measured return loss on a manufactured model of FIG. 9 measured at feeding port F1.

FIG. 10 shows the measured return loss [dB] on the manufactured model of FIG. 9 measured at feeding port F1 and mounted as explained in FIG. 3. The antenna is measured on a ground plane of 1 $m^2$. The antenna is placed in a protective cap of ABS material.

Figure 11:
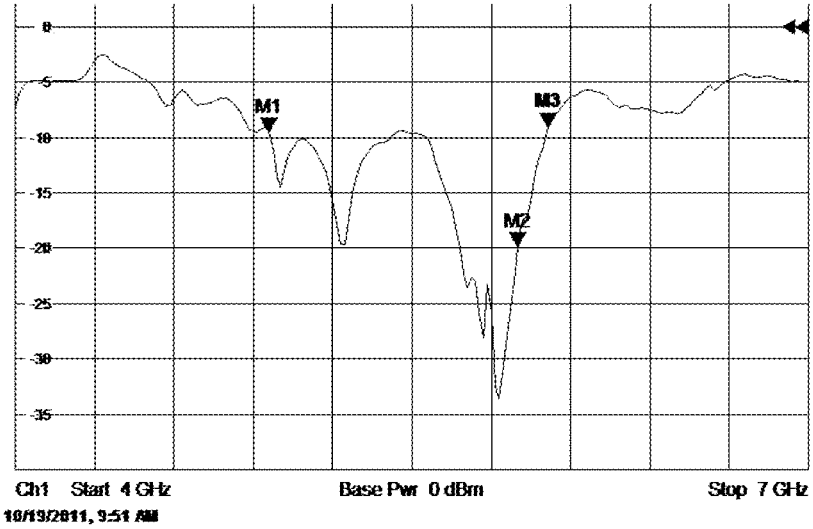
FIG. 11 shows the measured return loss on a manufactured model of FIG. 9 measured at feeding port F2.

In FIG. 10, the points M1, M2 and M3 are for frequencies 825 MHz, 960 MHz and 1.7 GHz. M1 and M2 show the GSM 800 and the GSM 900 frequency band, and M3 shows the lower frequency of GSM1800/GSM1900/UMTS. FIG. 11 shows the measured return loss [dB] on the manufactured model of FIG. 9 measured at feeding port F2 and mounted as explained in FIG. 3.

In FIG. 11, the points M1, M2 and M3 are for frequencies 4.958 GHz, 5.9 GHz and 6.014 GHz. M1-M2 is the WiFi band and M2-M3 is the IEEE802.11p band.

Figure 12:
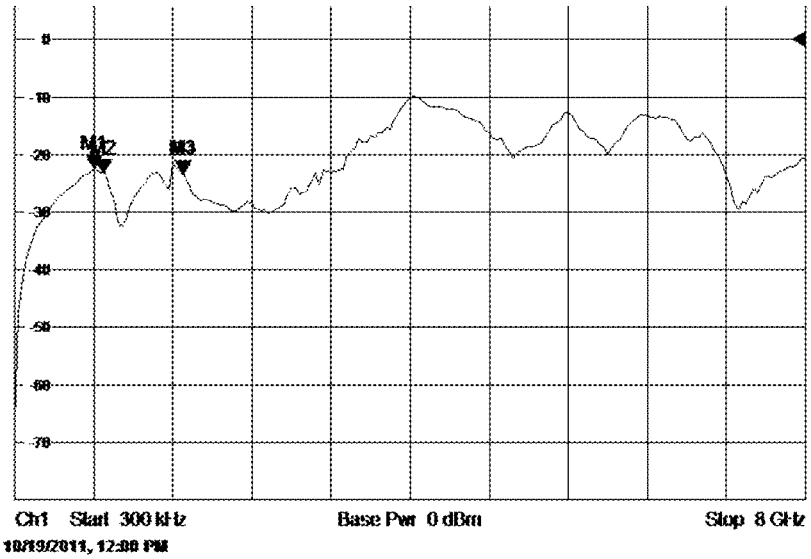
FIG. 12 shows the measured isolation on the manufactured model of FIG. 9 measured between feeding port F1 and F2.

FIG. 12 shows the measured isolation [dB] on the manufactured model of FIG. 9 measured between feeding port F1 and F2 and mounted as explained in FIG. 3. As observed, the isolation between both integrated structures is more than 20 dB at the cellular and 802.11b/g frequencies and more than 15 dB at the 802.11a and p frequencies. In FIG. 12, the points M1, M2 and M3 are for frequencies 800 MHz, 900 MHz and 1.7 GHz and these are isolation frequencies.

The following frequency bands are measured for a return loss limit of −9.5 dB (VSWR 2):

Lower band: 825-960 MHz
Intermediate band: 1.7-4.2 GHz
Higher band: 4.95-6.0 GHz The proposed reduced size highly integrated multiband antenna can be used for several standards like:

GSM 900: 880-960 MHz
GSM 1800: 1710-1880 MHz
UMTS: 1930-2170 MHz
GSM 850: 824-894 MHz
PCS: 1850-1990 MHz
WLAN 802.11b/g: 2.407-2.489 GHz
WLAN 802.11a: 4.915-5.825 GHz
WAVE 802.11p: 5.855-5.925 GHz

Figure 13:
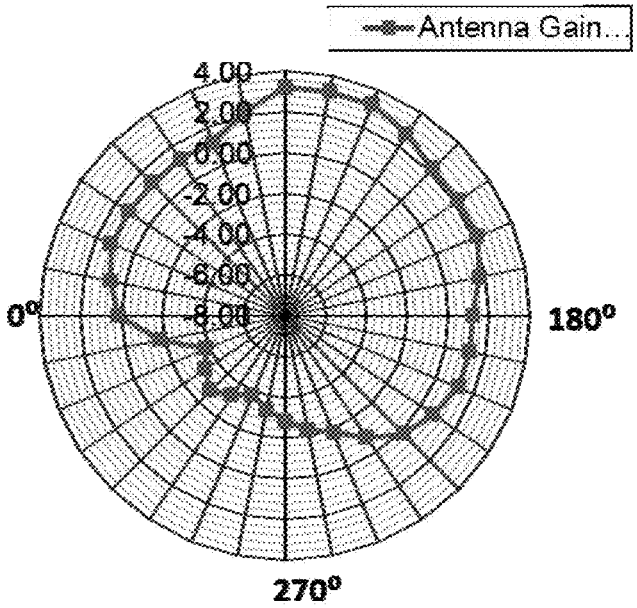
FIG. 13 shows the radiation pattern at a frequency of 900 MHz.

This antenna model is only an example and is not limited to the dimensions shown, and the antenna can be straightforwardly redesigned for other frequency bands. FIG. 13 shows the radiation pattern measured in an RF anechoic chamber recorded at a frequency of 900 MHz. The antenna structure is excited at feeding port F1 and a horn antenna receives the transmitted power in a 360° radial grid in a clockwise direction at a set-up distance of 2.5 m. It can be observed that this antenna is not fully omni-directional although gain figures remain larger than 0 dBi for almost 75% of the radial grid. The main lobe gain magnitude is sufficient, i.e. 3.2 dBi and is found at an angle of 67° in a clockwise rotation and relative to the forward direction.

Figure 14:
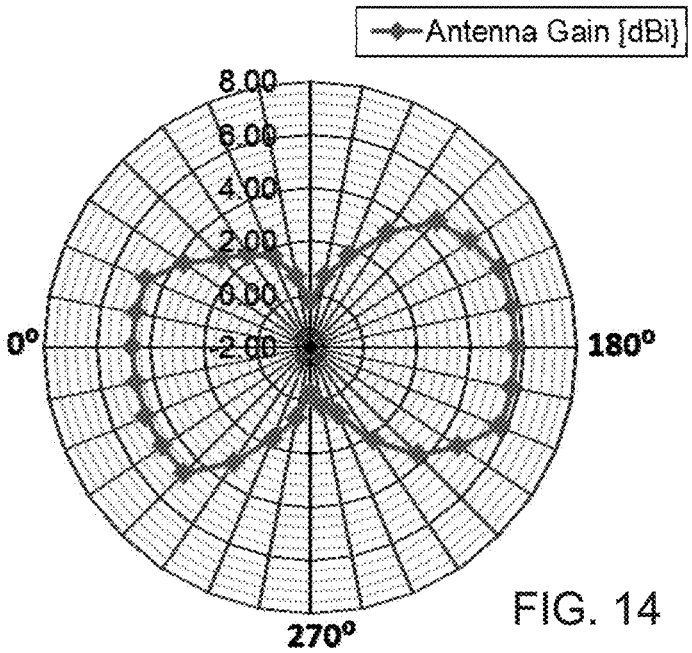
FIG. 14 shows the radiation pattern at a frequency of 2.5 GHz.

FIG. 14 shows the radiation pattern measured in an RF anechoic chamber recorded at a frequency of 2.5 GHz. The antenna structure is excited at feeding port F1 and a horn antenna receives the transmitted power in a 360° radial grid at a set-up distance of 2.5 m. It can be observed that this antenna is not fully omni-directional although gain figures remain larger than 0 dBi except for the direction perpendicular to the axis of the shark fin unit. The main lobe gain magnitude is high, i.e. 5.7 dBi and is found in the forward direction.

Figure 15:
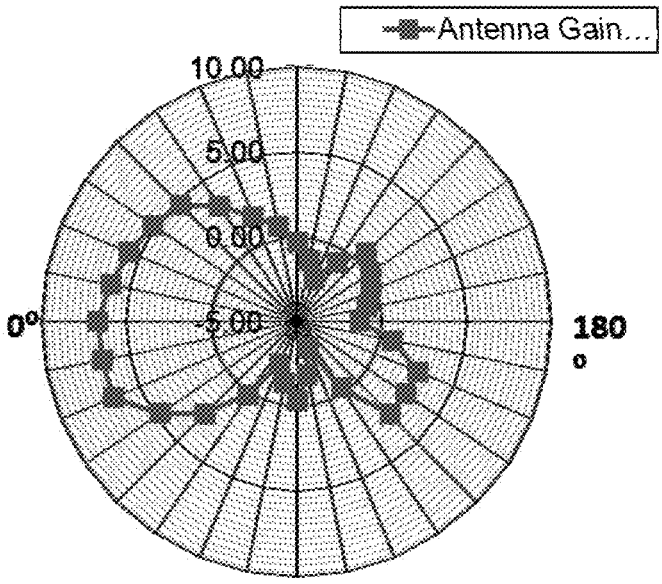
FIG. 15 shows the radiation pattern at a frequency of 5.9 GHz.

FIG. 15 shows the radiation pattern measured in an RF anechoic chamber recorded at a frequency of 5.9 GHz. The antenna structure is excited at feeding port F2 and a horn antenna receives the transmitted power in a 360° radial grid at a set-up distance of 2.5 m. It can be observed that this antenna is clearly directional, i.e. in the forward direction. The main lobe gain magnitude is high, i.e. 6.7 dBi and is found in to the forward direction. This antenna, radiating mainly in the forward direction combined with an additional separate antenna behind the multiband antenna as shown in FIG. 3, radiating in the backward direction can provide a full-range solution for 802.11p in diversity mode. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A multi-band antenna comprising:

a planar substrate which is configured for vertical mounting in use, and has a bottom edge and a top edge;

a conductor pattern printed on one side of the substrate and which in use is grounded at one end to a horizontal conducting plane, wherein the conductor pattern comprises a continuous conductor area having a plurality of slots defined into the area, the slots at one end opening to an edge of the conductor area, the slots comprising:

a first slot having a horizontal track located proximate the top edge and at least one downward vertical track extending down from one end;

a second slot having a horizontal track located proximate the bottom edge and at least one upward vertical track extending down from one end, wherein the downward and upward vertical tracks end with a gap between them; and a third slot extending in the vertical direction and open at the top, the third slot being formed to the side of the first and second slots, adjacent the upward and downward vertical tracks;

a first antenna feed to the horizontal track of the second slot; and a second antenna feed to the third slot.

2. An antenna as claimed in claim 1, wherein the first antenna feed is for a lower frequency band and an intermediate frequency band, and the second antenna feed is for a higher frequency band.

3. An antenna as claimed in claim 2, wherein the lower frequency band is within 825-960 MHz, the intermediate frequency band is within 1.7-4.2GHz and the higher frequency band is within 4.95-6.0 GHz.

4. An antenna as claimed in claim 1, wherein the third slot has a width of 2.0 mm to 3.0 mm and a depth of 5.0 mm to 12.0 mm.

5. An antenna as claimed in claim 1, wherein the third slot defines an antenna which is operated at frequencies located between two anti-resonances, wherein a second anti-resonance frequency is lower than 3 times a first anti-resonance frequency.

6. An antenna as claimed in claim 1, wherein the at least one upward vertical track of the second slot is parallel to and spaced from the third slot (S3) by a distance which is 0.5 to 10 times the width of the third slot.

7. An antenna as claimed in claim 1, comprising a vehicle antenna.

8. An antenna as claimed in claim 7, further comprising an outer housing for mounting on a vehicle roof, the outer housing comprising a vertical web in which the planar substrate is positioned, wherein the outer housing has a height of less than 80 mm, a width of less than 70 mm and a length of less than 200 mm.

9. A vehicle communications system, comprising an antenna as claimed in claim 8, wherein the system further comprises a GPS module within the outer housing.

10. A vehicle communications system as claimed in claim 9, comprising a further high frequency antenna within the outer housing.

* * * * *